US006019207A

United States Patent [19]

Cole

[11] Patent Number: 6,019,207

[45] Date of Patent: Feb. 1, 2000

[54] APPARATUS FOR HOUSING AND SERVICING A CURRENCY ACCEPTOR AND CURRENCY STACKER

[76] Inventor: Joseph W. Cole, 10228 Angle Peak Ct., Las Vegas, Nev. 89134

[21] Appl. No.: 08/969,718

[22] Filed: Nov. 13, 1997

[51] Int. Cl.[7] ..... G07F 7/04; G07F 9/00

[52] U.S. Cl. ..... 194/206; 194/350

[58] Field of Search ..... 194/206, 207, 194/350; 271/207

[56] References Cited

U.S. PATENT DOCUMENTS

| | | | |
|---|---|---|---|
| 5,386,903 | 2/1995 | Rothschild et al. | 194/350 |
| 5,505,439 | 4/1996 | Watabe et al. | 271/207 |
| 5,676,231 | 10/1997 | Legras et al. | 194/206 |

FOREIGN PATENT DOCUMENTS

| | | | |
|---|---|---|---|
| 2 212 314 | 7/1989 | United Kingdom | 194/350 |

*Primary Examiner*—Robert P. Olszewski
*Assistant Examiner*—Bryan Jaketic
*Attorney, Agent, or Firm*—Michael McEntee

[57] ABSTRACT

The invention describes an improved currency handling machine for use with a vending machine cabinet having at least one access door, said currency handling machine comprises a combination of: 1. a currency funnel mounted on the access door, 2. a frame mounted for rotation about an axis in spaced relationship to the access door, 3. a currency acceptor mounted on the rotating frame, 4. a currency stacker mounted on the rotating frame and mounted in currency receiving relationship to the currency acceptor, and 5. locking means to align an input lip of the currency acceptor with an output lip of the currency funnel to maintain a predetermined alignment and predetermined gap between the currency funnel and the currency acceptor when the access door is closed.

2 Claims, 5 Drawing Sheets

APPARATUS FOR HOUSING AND SERVICING A CURRENCY ACCEPTOR AND CURRENCY STACKER

BACKGROUND OF THE INVENTION

This invention relates to a device to mount and position for service, a currency acceptor within a gaming machine or other devices which utilize a currency acceptor. Such devices include automated teller machines, automated gasoline pumps, automated ticket machines, and machines for selling goods. For convenience, this entire class of machines will be referred to below and in the claims as vending machines.

The problem of mounting a currency acceptor and currency stacker within a gaming or other vending machine includes the need to be very compact (i.e. have a small envelope). Equally important is the need for quick, easy service of the currency handling equipment. Service being defined by clearing the acceptor of mis-fed currency and removal of the currency cassette.

The problem includes the need for controlled movement of the currency acceptor during service. This is crucial to the process to prevent damage to the acceptor's delicate electronics.

The means of mounting and positioning the currency acceptor has been addressed by the prior art in several ways. One solution is to permanently mount the acceptor within an enclosure and access the unit by an access door on the front, side or rear of the vending machine. Another technique utilizes a slide mechanism such as that shown in U.S. Pat. No. 5,251,738 issued on Oct. 12, 1993, to Stanley Dabrowski. While these techniques function to secure the acceptor within the enclosures and provide a means of service, they require the main enclosure be opened or an access panel be opened and the acceptor to be pulled from its enclosure. These methods of service can often significantly shorten the life and reduce the reliability of the delicate electronics typically found within vending machines. Further, the currency acceptor electronics are themselves often damaged during the servicing of the machine's other components.

OBJECTS OF THE INVENTION

It is an object of the invention to provide an improved means of aligning the currency acceptor with the currency funnel mounted on the access door of a vending machine such that a predetermined gap is maintained between the currency funnel and the currency acceptor. This gap thereby mechanically insulates the currency acceptor from vibration and pounding suffering by the access door, either from the patrons or from the service person slamming the access door.

It is a further object of the invention to provide a high degree of electrical insulation between the currency funnel attached to the access door, and the currency acceptor. This is particularly important in desert environments, such as Las Vegas, where static charge accumulates on a patrons skin and they discharge a high voltage shock onto the metal access door and the currency funnel. The delicate electronics of the currency acceptor operate at 5 volts, while the electrical charge from static electricity frequently reaches 10,000 volts. Such discharges can destroy the electronics of the currency acceptor.

It is an object of the invention to protect the currency acceptor's delicate electronics from "shock" associated with positioning the device during routine servicing. Thus, after the access door is opened, a harried service person often will aggressively rotate the currency acceptor to the position to remove currency and in so doing, cause the rotating device to crash against its mechanical limit. The invention provides a means of cushioning this rotary motion. Even without the means of cushioning, the use of rotation of the currency acceptor is still far superior to the prior art method of sliding the currency acceptor out of the machine for two reasons: 1. The device never leaves the protective surrounding of the outer frame, and 2. the device has only one degree of freedom, i.e. rotation, rather than six degrees of freedom.

It is an advantage of the invention that it greatly reduces the size of the working envelope needed to provide currency acceptance and currency storage within a vending machine cabinet.

Another object of the invention is to greatly increase the speed and ease of service such that lower skilled persons at a vending machine location may clear a currency acceptor jam rather than waiting for an electronic technician to arrive to clear it.

Another object of the invention is to permit separation of the function of clearing currency jams in the currency acceptor from the function of collecting the currency from the currency stacker.

It is an object of the invention to enable a vending machine to accommodate various makes and models of currency acceptor's and currency stackers so that the vending machines can easily adapt to new equipment.

SUMMARY OF THE INVENTION

In accordance with the preferred embodiment of the invention, the currency acceptor is housed in a permanent metal structure (outer frame) which is affixed within a vending machine cabinet. A movable sub-structure called the rotating frame is located with the outer frame housing and is mounted on pivots to allow for rotation. The rotating frame is designed to be used with a wide variety of currency acceptors and currency stackers. Between the outer frame and the rotating frame lies an activation arm which when pulled allows for controlled rocking, either forward or backward, of the rotating frame with its currency acceptor and currency stacker.

Special damping and positioning means protect the delicate electronics of the currency acceptor by controlling the speed of rotation of the rotating frame and limiting the positions to which the rotating frame may be rotated.

Detents on the rotating frame, when required, interfit with the activation arm, so that the rotating frame is positioned and locked in either of three rotary positions: a. clearing a currency mis-fed, b. removal of the currency cassette, and c. currency accepting in regular use by the consumer.

BRIEF DESCRIPTION OF THE DRAWINGS

These and other objects and advantages of the invention will be apparent from reading the following description in conjunction with the drawings, in which.

DESCRIPTION OF THE PREFERRED EMBODIMENT

Figure 1:
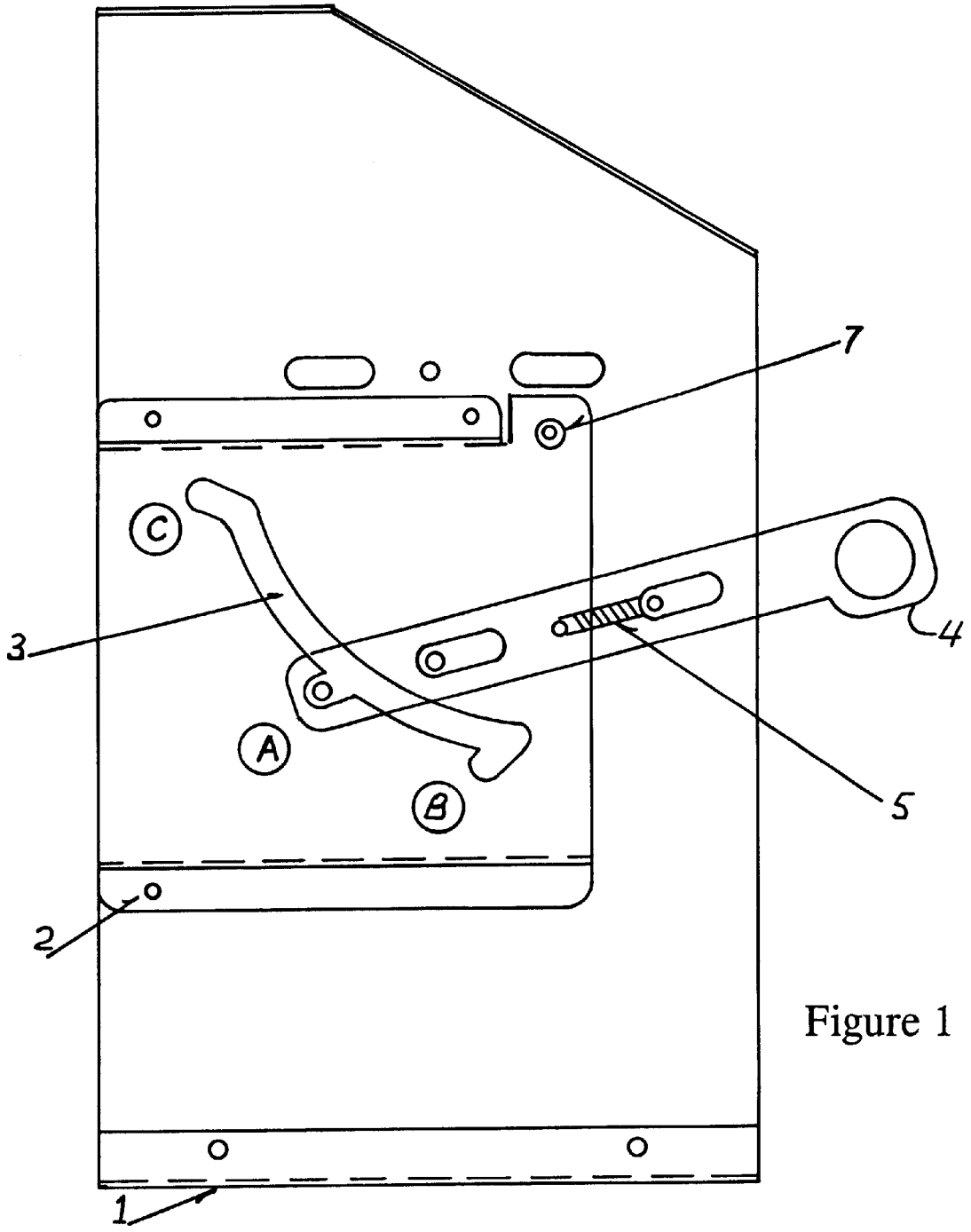
FIG. 1 is a side view of the outer structure, rotating structure and activation arm. The vending cabient is not shown in FIG. 1, but is shown in FIG. 3.
Figure 3:
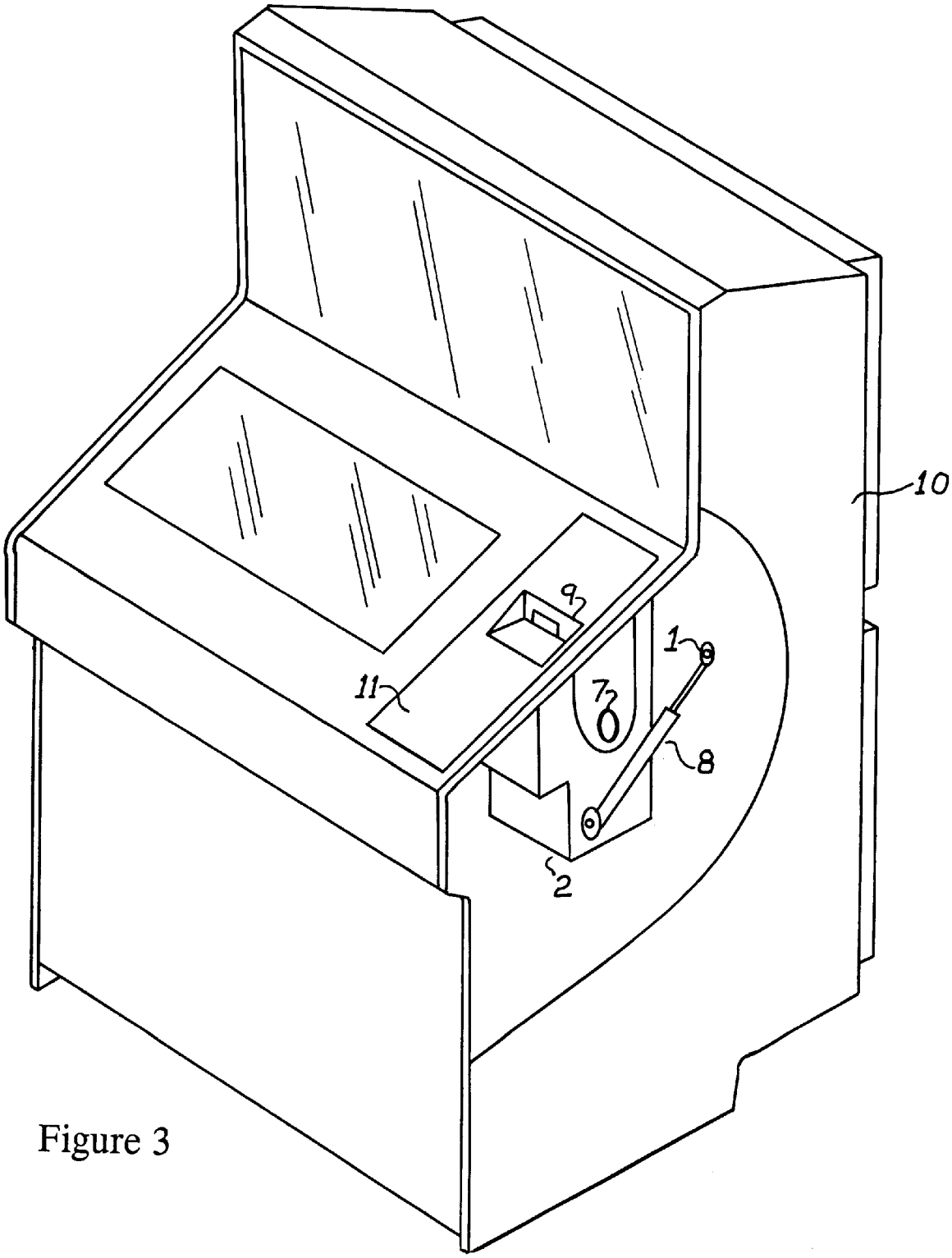
FIG. 3 is a perspective view of the cabinet of a vending machine, with a broken out view illustrating the rotary frame in its operating position. One means of restraining the rotation of the rotary frame is by means of a hybrid air spring/hydraulic shock absorber commonly available as a damper gas spring.

Referring to FIG. 1, the device is illustrated in its upright, or currency receiving position. This same position is illustrated in FIG. 3. The device comprises an outer frame 1 rigidly mounted to the vending machine cabinet (not shown in views 1, 2, 4, and 5, but shown in view 3) and rotating frame 2 which is mounted for rotation about pivots. The pivots connect the rotating and outer frames. The rotating frame has mounted on it a currency acceptor. Formed in a wall of the rotating frame are 3 detents formed as slots 3, and suitable for interfitting with a boss located on an activation arm 4. By this means, exact rotary positioning is accomplished by the service person grasping the rotating frame and rotating it while pulling the activation arm with his other hand.

As will often happen, the service person will be rushed, harried, impatient, or simply careless, and the rotating frame will be rotated aggressively and cause mechanical shock to the delicate electronics in the currency acceptor. To prevent this, a hybrid gas spring 8 is utilized, and is shown in FIG. 3. It connects a pivot point on the rotating frame to a pivot point 7, between the rotary frame and the outer frame. In an alternate preferred embodiment, the hybrid gas spring connects the rotating frame to a wall of the vending machine cabinet. In that case the wall of the vending machine often functions as the equivalent of part of the outer frame.

The detents, A, B, C, reflect the operating, currency clearing and currency removal positions respectively. When released, a pin located on the end of the activation arm 4 is pulled into and retained in the detent by virtue of a spring 5.

The rotating frame 2 is so designed as to accommodate various makes and models of currency acceptors. Further, the pivot 7 of the rotating frame can be moved to change the angle of ascent or descent. This allows the acceptor to clear various components within the enclosure and provide for unique profiles of the enclosure. This feature is a major benefit and improvement over the prior art.

Figure 2:
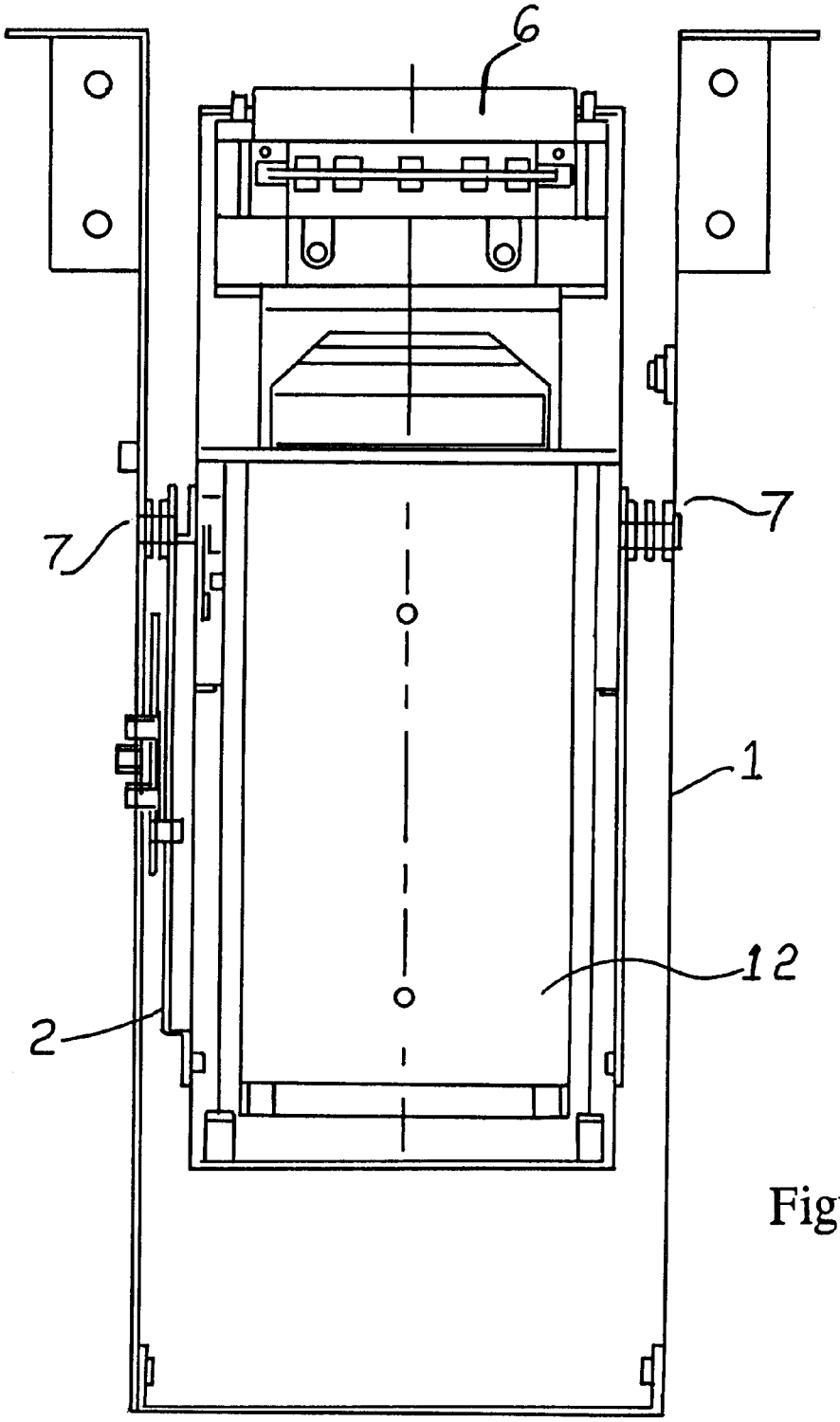
FIG. 2 is a frontal view of the device, including the currency acceptor.

With particular reference to FIG. 2, the currency acceptor 6 is shown mounted in the rotary frame 2, on pivots 7 in its currency receiving position.

A hybrid gas spring is a gas cylinder assembly which provides axial bias force and also restrains the rate of change of position which that axial force causes. The motion of a piston mounted on the end of the connecting rod located within the cylinder is slowed by passage of a liquid through a hole or passageway of predetermined diameter, such that the liquid passes from one side of the piston to the other side of the piston. The liquid in the cylinder has viscosity and therefore resist flow through the passageway from one side of the piston to the other side when the rotating frame is rotated. High pressure gas, typically nitrogen gas, is located in the cylinder and acts on the net cross sectional area of the connecting rod to force that rod outwardly towards the ambient air. The piston, of course, stops the rod from ejecting completely into the ambient air.

Besides use of a hybrid gas spring, which includes a gas spring and hydraulic damping, other methods may be employed to achieve the desired result, including a counterbalance, torque hinge or by positioning the pivot point relative to the rotating frame so that the combined center of gravity of the frame, currency acceptor, and currency stacker. These are equivalent means to a hybrid gas spring, although the preferred embodiment utilizes hybrid gas spring because it is clearly superior in its damping effect.

Controlling the rate of rotation is important in protecting the delicate electronics of the acceptor. It is evident that without control, the acceptor would be subjected to high impact forces as the rotating device comes to a sudden positional stop.

FIG. 3 is a perspective view showing the currency funnel 9, vending machine cabinet 10, access door 11, hybrid gas spring 8, pivot 7, and rotary frame 2.

Figure 4:
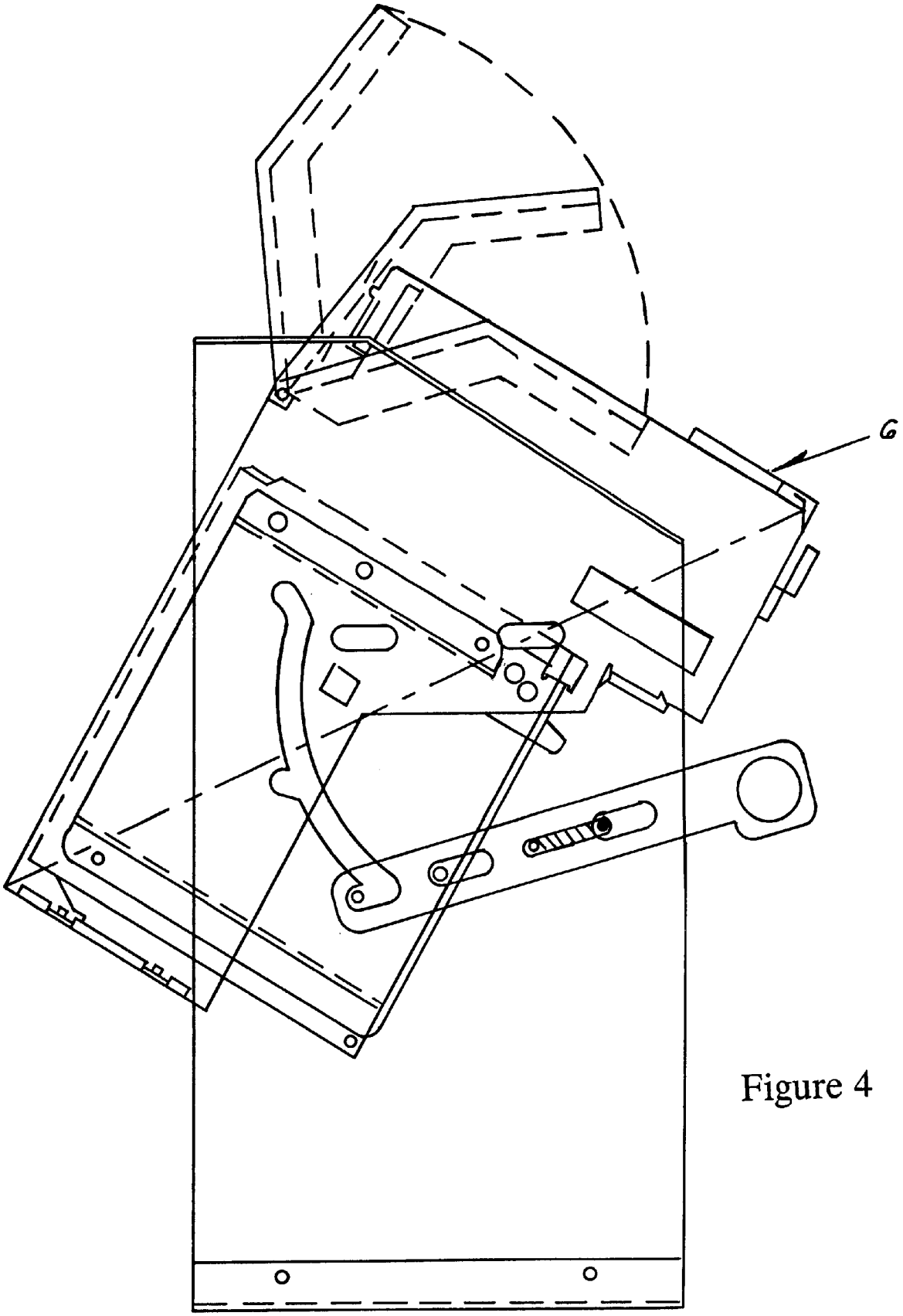
FIG. 4 is a side view illustrating the device in its clearing position to allow clearing a currency mis-fed. The lid rotating upwards in the view is typically hinged on the currency acceptor, although it could be hinged on the rotating frame.
Figure 5:
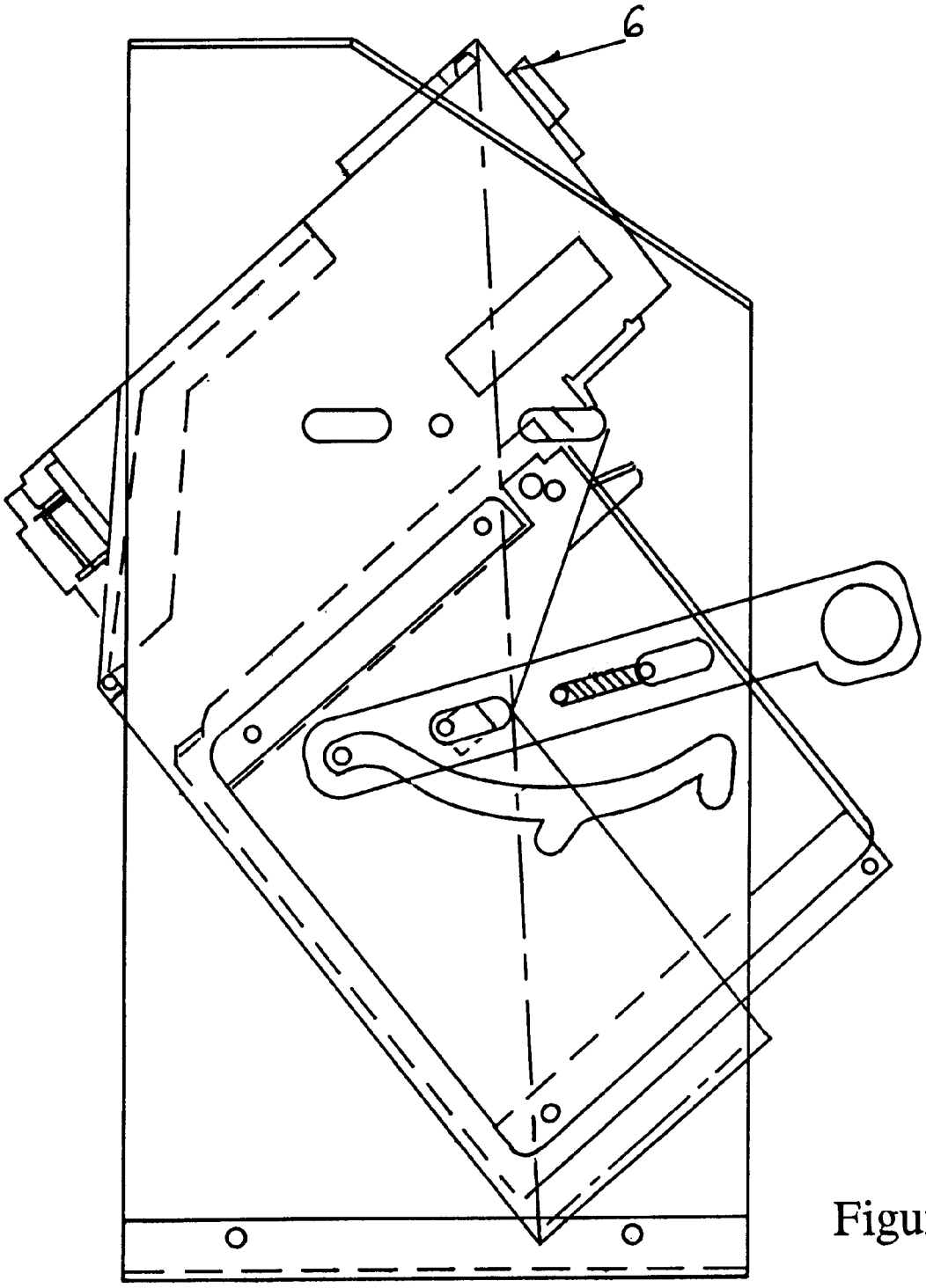
FIG. 5 is a side view illustrating the device positioned for currency casette removal.

The illustrations of FIGS. 1,4, and 5 depict the currency acceptor 6 in its various positions A, B, and C as previously described. It will also be appreciated that by rotating the currency acceptor within the outer frame, a much smaller access panel is required to provide complete serviceability to the acceptor and currency stacker 12 in FIG. 2.

It is to be understood that the form of the invention herewith shown and described is to be taken as a preferred example of the same and that various changes in shape, size and arrangement of parts may be resorted to, without departing from the spirit of the invention or the scope of the subjoined claims.

I claim:

1. An improved currency handling device, for use with a vending machine cabinet having at least one access door, said currency handling machine, comprising in combination, a currency funnel mounted on the access door, a frame mounted for rotation about an axis in spaced relationship to the access door, a currency acceptor mounted on the rotating frame, a currency stacker mounted on the rotating frame and mounted in currency receiving relationship to the currency acceptor, alignment means to align an input lip of the currency acceptor with an output lip of the currency funnel to maintain a predetermined alignment and predetermined gap between the currency funnel and the currency acceptor when the access door is closed, which alignment means includes a locking lever mounted in sliding relationship to the rotating frame, and a boss mounted on the locking lever, and the frame has formed in it detent means which interfit with the boss of the locking lever when the frame is rotated into any of three positions.

2. An improved currency handling device, for use with a vending machine cabinet having at least one access door, said currency handling machine, comprising in combination, a currency funnel mounted on the access door, a frame mounted for rotation about an axis in spaced relationship to the access door, a currency acceptor mounted on the rotating frame, a currency stacker mounted on the rotating frame and mounted in currency receiving relationship to the currency acceptor, alignment means to align an input lip of the currency acceptor with an output lip of the currency funnel to maintain a predetermined alignment and predetermined gap between the currency funnel and the currency acceptor when the access door is closed, which alignment means includes a locking lever mounted in sliding relationship to the rotating frame, and a boss mounted on the locking lever, and the frame has formed in it detent means which interfit with the boss of the locking lever when the frame is rotated into any of three positions, and the currency stacker includes a door hinged on the rotating frame and the door has locking means to secure the closed door to the rotating frame.

* * * * *